US005902414A

United States Patent [19]

Keal et al.

[11] Patent Number: 5,902,414

[45] **Date of Patent: *May 11, 1999**

[54] APPARATUS AND METHOD FOR RENOVATING PLAYING SURFACES

[75] Inventors: Mark Anthony Keal, Granby; Charles Clifford Seager Lawrence, Newark, both of United Kingdom

[73] Assignee: Air Force Limited, Jersey, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/604,932

[22] PCT Filed: Sep. 1, 1994

[86] PCT No.: PCT/GB94/01898

§ 371 Date: Feb. 29, 1996

§ 102(e) Date: Feb. 29, 1996

[87] PCT Pub. No.: WO95/06781

PCT Pub. Date: Mar. 9, 1995

[30] Foreign Application Priority Data

Sep. 1, 1993 [GB] United Kingdom ..... 9318087

[51] Int. Cl.[6] ..... A47L 5/14

[52] U.S. Cl. ..... 134/37; 15/345; 15/348; 15/405

[58] Field of Search ..... 15/345, 348, 405; 134/37; 239/1

[56] References Cited

U.S. PATENT DOCUMENTS

| | | | |
|---|---|---|---|
| 759,141 | 5/1904 | Thurman | 15/405 X |
| 2,990,019 | 6/1961 | Finn | 15/345 X |
| 3,104,187 | 9/1963 | Jenkins et al. | 134/37 X |
| 3,493,989 | 2/1970 | Karijo | 15/345 |
| 3,495,932 | 2/1970 | Tuma | 15/345 X |
| 3,562,845 | 2/1971 | Hayden | 14/405 X |
| 4,018,483 | 4/1977 | Smith | 15/405 X |
| 4,707,879 | 11/1987 | Moszkowski | 15/345 |
| 5,249,332 | 10/1993 | Wilkerson | 15/348 X |
| 5,562,779 | 10/1996 | Allaway et al. | 15/345 X |

FOREIGN PATENT DOCUMENTS

| | | | |
|---|---|---|---|
| 8628657 | 12/1986 | Germany . | |
| 53-115567 | 10/1978 | Japan | 15/345 |
| 8503498 | 8/1985 | WIPO . | |
| 9229272 | 11/1992 | WIPO . | |

*Primary Examiner*—Chris K. Moore
*Attorney, Agent, or Firm*—Lorusso & Loud

[57] ABSTRACT

An apparatus (5) for renovating synthetic grass playing surfaces (1) which include a layer of particulate material. The apparatus (5) comprises a plenum chamber (20) which directs a fast moving jet of air against the particulate so as to dislodge it and direct the particulate into a collection chamber (40). The plenum chamber (20) may be adapted to effect a reciprocating motion parallel to a playing surface (1) and orthogonal to a direction of conveyance of the apparatus (5) over the playing surface (1). The collection chamber (20) may incorporate a screw conveyor system (44) to displace particulate material directed into the collection chamber (20) to an appropriate container which may be conveyed along side the apparatus (5) by a separate vehicle. The apparatus (5) may further include a particulate dispensing apparatus for applying an evenly spread layer of fresh particulate material in place of that which has been dislodged and removed from the playing surface (1).

19 Claims, 8 Drawing Sheets

APPARATUS AND METHOD FOR RENOVATING PLAYING SURFACES

This invention relates to an apparatus and method for renovating synthetic playing surfaces particularly, but not exclusively, sports surfaces such as synthetic grass tennis courts, synthetic bowling greens and synthetic playing fields. Such playing surfaces generally include an artificial turf which is infilled with a layer of sand or other particulate material as part of their structural make-up.

This layer of sand becomes compacted through use and also becomes contaminated with dust and dirt. The compacted layer substantially reduces correct drainage of the surface, is harsh on the feet and can be very slippery when wet. Accordingly, these playing surfaces require renovation from time to time.

An apparatus for renovating such playing surfaces is disclosed in the present applicants' PCT application WO92/20272. This apparatus utilises a jet of compressed air to loosen the layer of particulate material. In one arrangement, the loosened material enters a separation device in which relatively lightweight dust and dirt particles are separated from the coarse, relatively heavy, particulate material which is then returned to the synthetic surface. This device works extremely well when the particulate material is dry. If, however, the particulate material is wet, it is difficult to effect any dust or dirt separation and in another arrangement disclosed in WO92/20272 an alternative head is used which merely effects dislodgement of the layer of particulate material and returns it to the playing surface, including the dust and dirt. Whilst this is not ideal, it at least decompacts the surface and thus effects a degree of renovation.

One of the disadvantages of the apparatus disclosed in WO92/20272 is that the effective width of apparatus is limited due to the practical size of compressor which can be deployed in conjunction with the apparatus to supply the required amount of compressed air. Consequently, the time taken to renovate a given playing surface is relatively large.

Another disadvantage is that already referred to, namely the less than 100% renovation achieved when the playing surface is wet.

According to the present invention there is provided an apparatus for renovating a synthetic playing surface. In accordance with one embodiment thereof the apparatus comprises means for dislodging and entraining particulate matter layered on a synthetic playing surface, said apparatus comprising a plenum chamber having a compressed air inlet and a plurality of air outlets through which air can be expelled at an inclined angle against a playing surface so as to dislodge particulate matter layered thereon and to direct it toward a collection chamber, wherein the apparatus includes plenum chamber drive means which imparts a periodic motion to the plenum chamber relative to said apparatus, and substantially in the plane of said plurality of air outlets.

In accordance with a further embodiment, the apparatus comprises means for dislodging, entraining and collecting coarse and fine particulate matter layered on a synthetic playing surface, said apparatus comprising a plenum chamber having a compressed air inlet and a plurality of compressed air outlets through which air can be expelled at an inclined angle against a playing surface so as to dislodge particulate matter layered thereon and to direct it into a collection chamber, said collection chamber including a first screw conveyor for removing coarse particulate matter from within said collection chamber.

Embodiments of the present invention will now be described, by way of example, with reference to the accompanying drawings in which.

Figure 1:
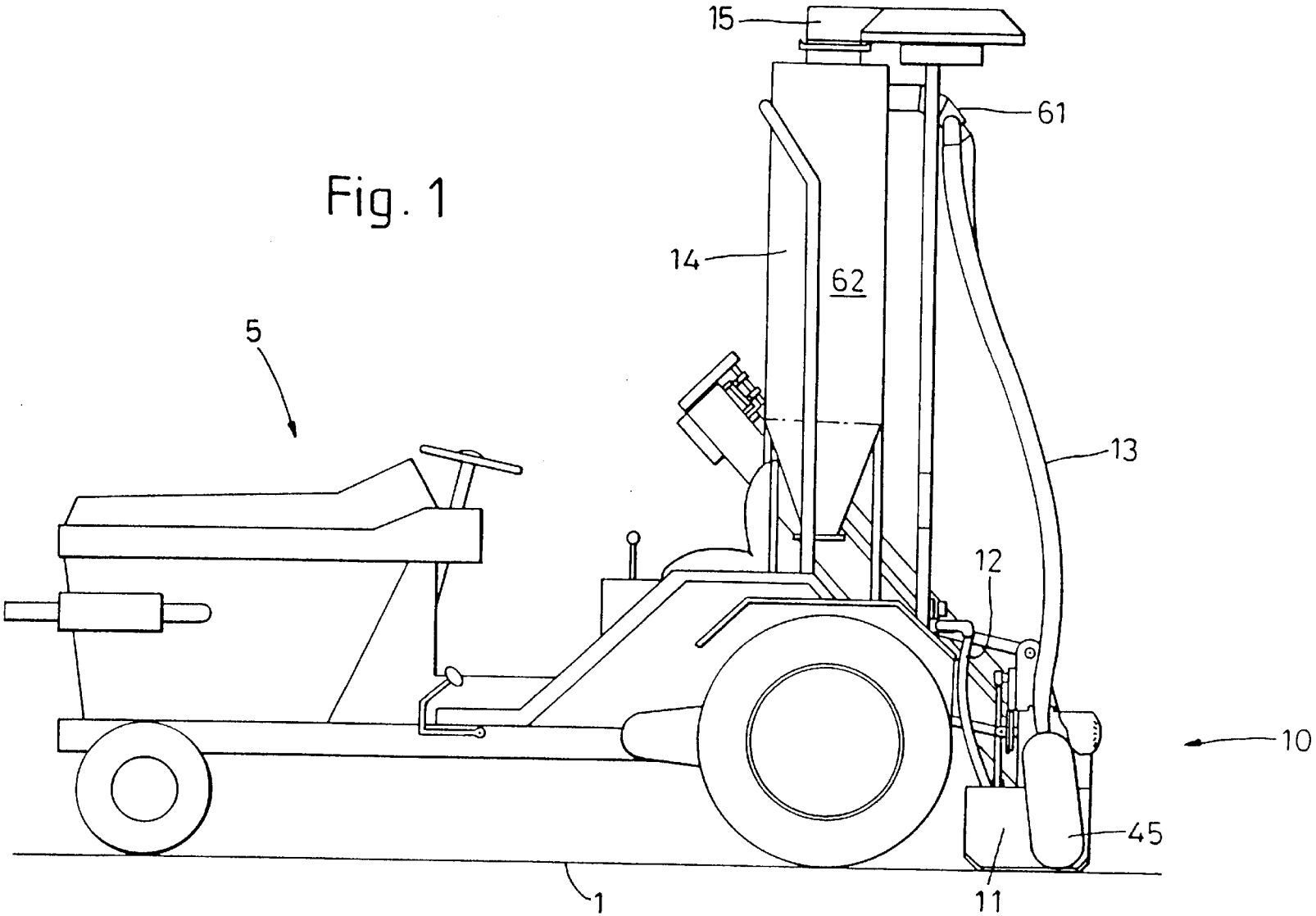
FIG. 1 shows a side view of a renovating apparatus according to the present invention mounted on a tractor.
Figure 2:
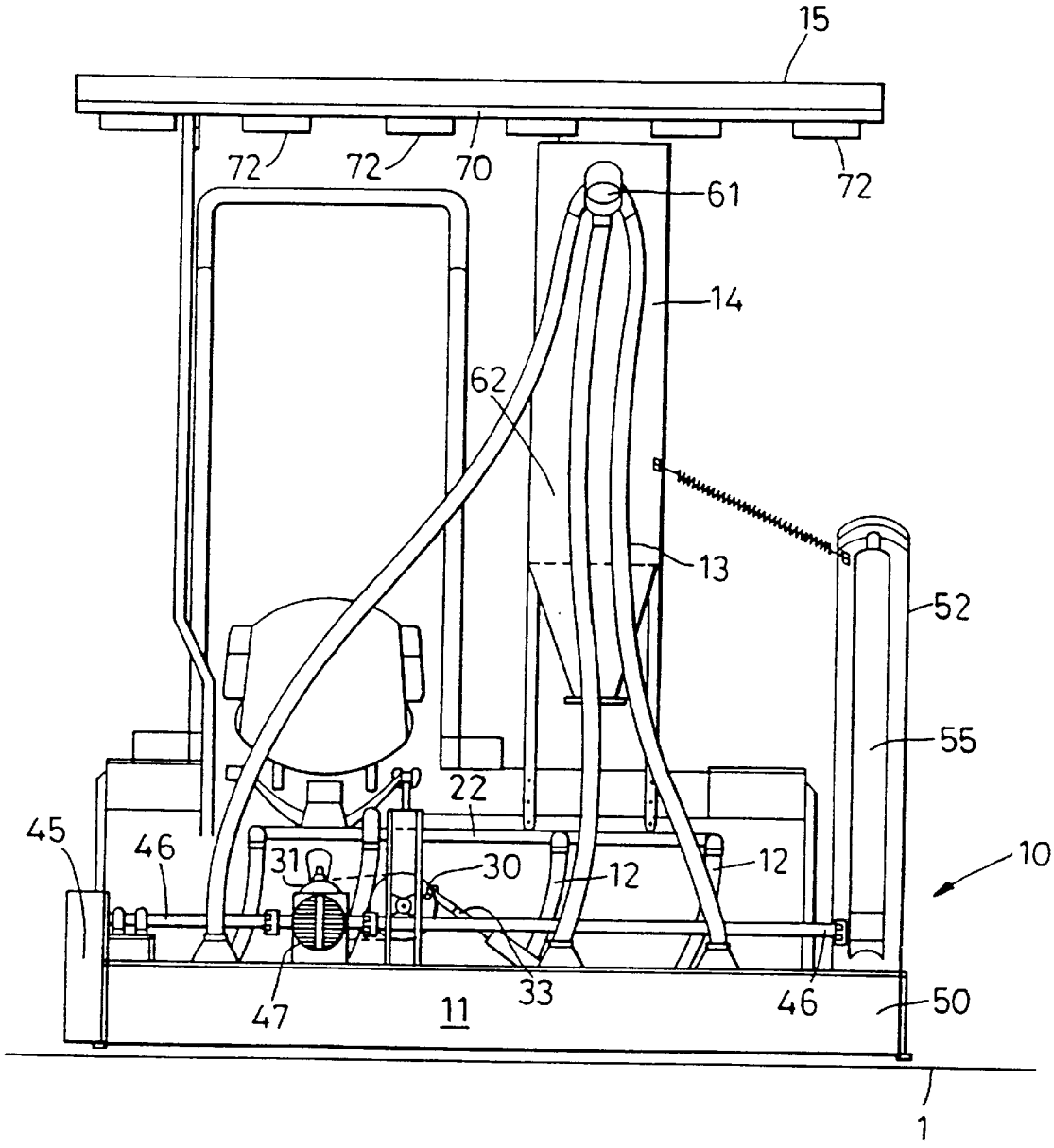
FIG. 2 shows a rear view of the renovating apparatus of FIG. 1.

With reference to FIGS. 1 and 2 there is shown a renovating apparatus 10 which is mounted on, or formed as an integral part of, a tractor 5. Any suitable form of vehicle or conveyance may be used in place of tractor 5, and the renovating apparatus 10 might alternatively be provided with integral wheels, steering and propulsion means.

The renovating apparatus includes a first structure 11 which houses a compressed air jet system to direct high pressure air at a playing surface 1 over which the vehicle is travelling in a forward direction (toward the left as shown in FIG. 1). Compressed air is supplied to the structure 11 by way of flexible supply pipes 12. The first structure 11 also includes a collection chamber (described hereinafter) to receive particulate matter which has been dislodged from the playing surface 1 by the action of the compressed air jet system. Exhaust pipes 13 are connected to the upper portion of the first structure 11 for carrying air and fine, airborne particulate material to an accumulation unit 14 and exhaust filtration unit 15.

Figure 3:
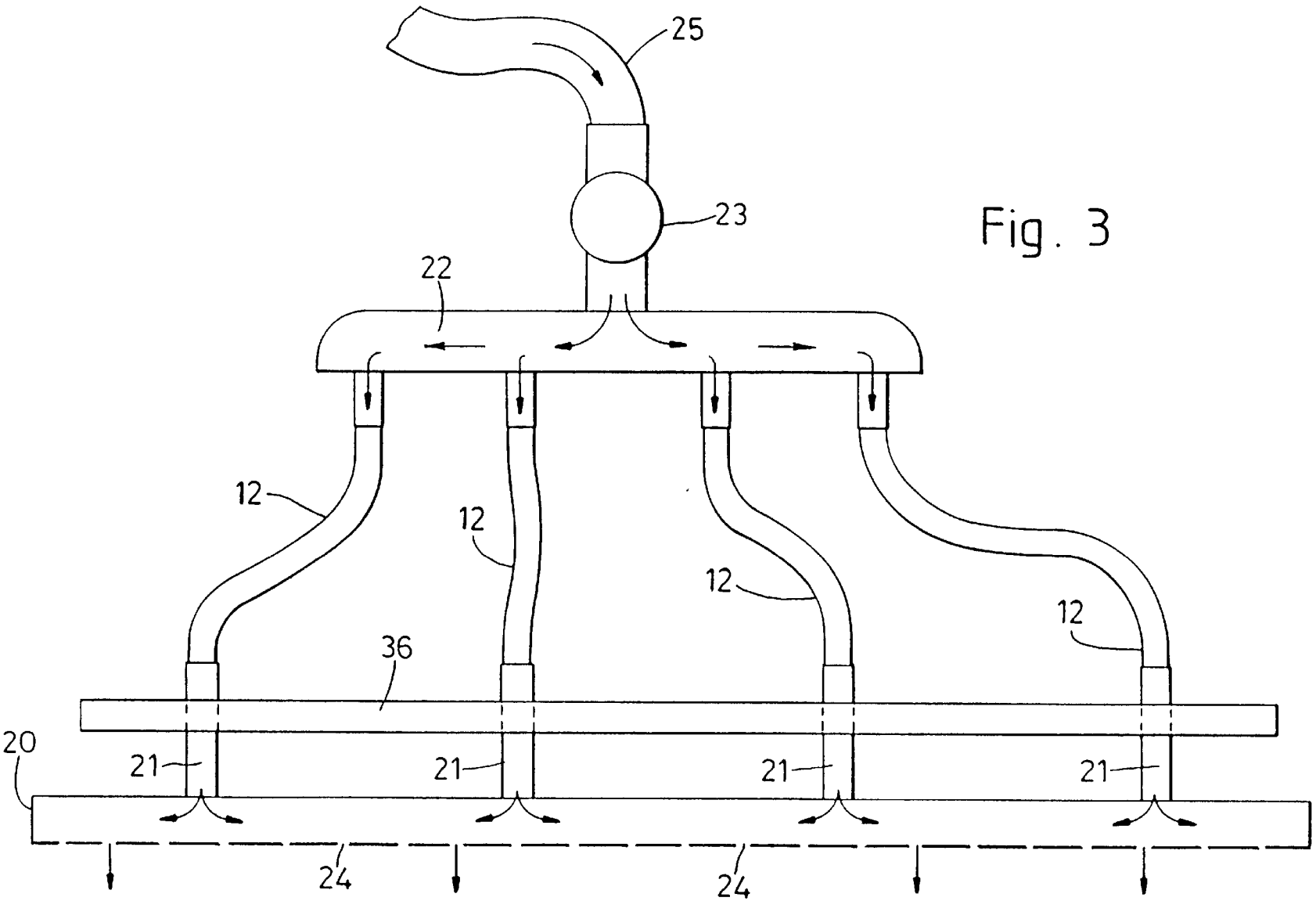
FIG. 3 shows a schematic rear view of a plenum chamber and air supply system of the renovating apparatus of claim 1.
Figure 4:
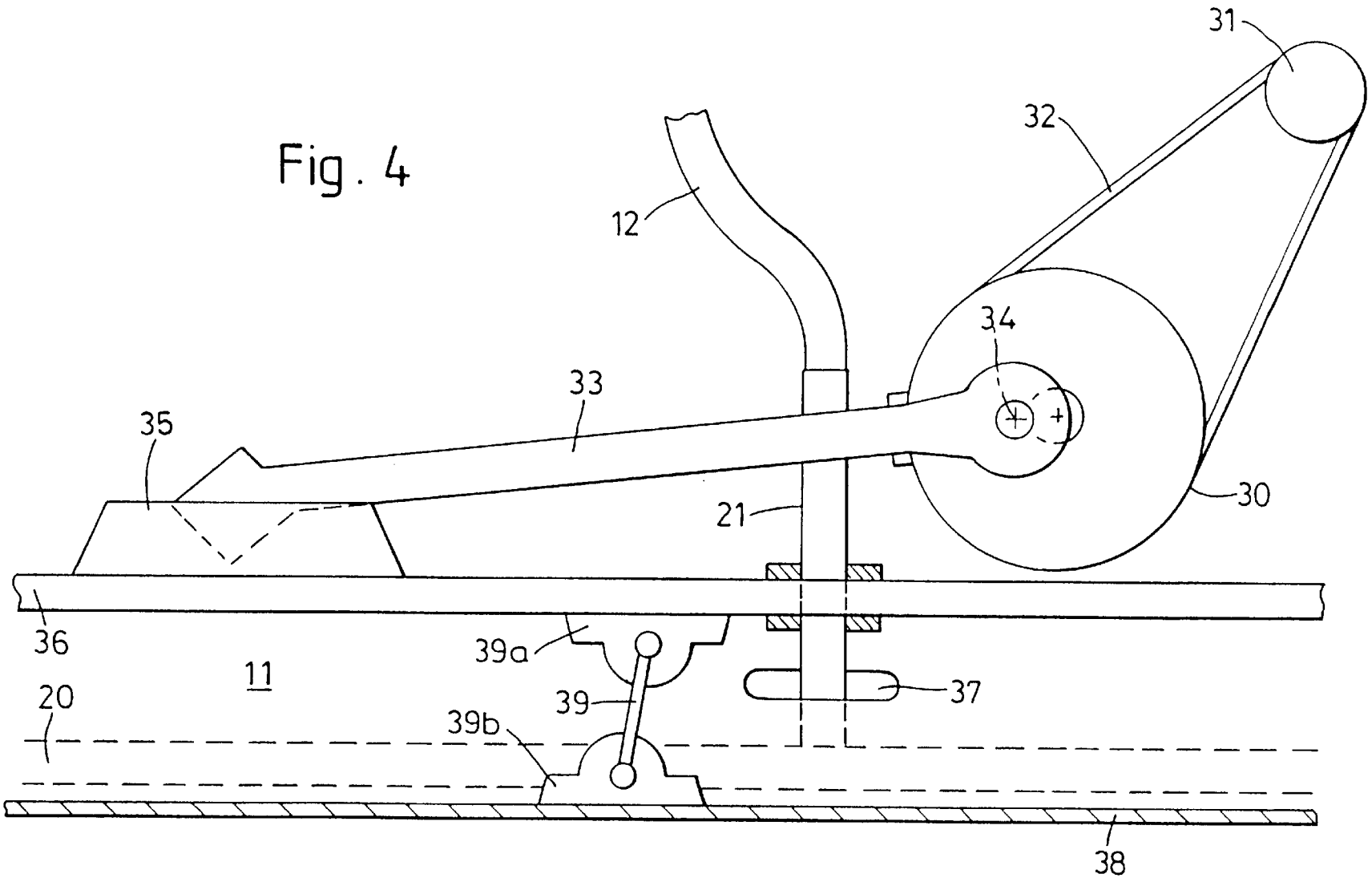
FIG. 4 shows a schematic rear view of the plenum chamber drive mechanism of the renovating apparatus of FIG. 1.

With reference to FIGS. 3 and 4, an embodiment of the compressed air jet system will now be described. A plenum chamber 20, which is preferably an elongate cylinder closed at each end, includes a plurality of air inlets 21 each of which is coupled to one end of a compressed air supply pipe 12. The other end of each respective compressed air supply pipe 12 is connected to a supply manifold 22 for the distribution of the compressed air to each supply pipe. An air cock 23 may be provided on the manifold 22 for isolation of the source of compressed air which is not shown in the figures. The compressed air source may be provided on board the vehicle 5 which conveys the renovation apparatus 10, but preferably, owing to the size and weight of the compressed air generator it is remotely located off the playing surface and coupled to the renovation apparatus by trailing flexible pipe 25. The plenum chamber 20 includes a plurality of pin hole outlets 24 on the underside thereof which are directed downward and, with reference to the direction of travel of FIG. 1, slightly backward toward a collection chamber to be described hereinafter. The pin hole outlets are, in a presently preferred embodiment, approximately 1.5 mm in diameter. The flow of compressed air through the system is indicated by way of the arrows on FIG. 3. A supporting bar 36 couples each air inlet 21.

The plenum chamber 20 and pin hole outlets 24 can also be configured separately, so that individual jet nozzles can be screw-threadedly or otherwise fitted to a universal design of plenum chamber. Advantages of this configuration are numerous, but specifically allow that: blocked jets can be discarded and replaced; the size of the jets may be readily altered to suit different playing surfaces and conditions; worn out jets can be replaced without replacement of the entire plenum chamber; jets can be manufactured very precisely and to higher specification than is possible or economical when integrally formed with the plenum chamber—for example, the jets can be hardened to give protection from the highly abrasive silica sand with which they will continually be bombarded.

A particular problem with prior art systems is the time taken to renovate a given area of playing surface. It will be appreciated that the time taken to renovate a playing surface is determined in part by the operational width of the apparatus 10, i.e. the effective length of the plenum chamber 20 in which pin hole outlets 24 are provided. Increasing the length of the chamber and thereby increasing the number of pin hole outlets 24 has the effect of increasing the area of playing surface covered with each traversal thereof by the vehicle 5, but in order to maintain the operational effectiveness of the compressed air jets, it is necessary to increase the volume of compressed air being supplied to the plenum chamber 20 commensurately with the increased number of pin hole outlets 24. In many instances, the use of larger air compressors is simply not practicable or is prohibitively expensive.

It has been determined that increasing the separation of the pin hole outlets 24 (i.e. decreasing the number per unit length of plenum chamber) while increasing the length of plenum chamber 20 in order to avoid the requirement of a larger air compressor inevitably degrades the renovating action of the apparatus. However, in accordance with one aspect of the present invention, this degradation is mitigated, and a substantial improvement in performance of the renovating apparatus is achieved by increasing the effective length of plenum chamber while maintaining the same number of pin hole outlets 24, together with providing oscillation of the plenum chamber 20 in a direction preferably substantially parallel to the longitudinal axis of the plenum chamber 20. The magnitude of the oscillation is preferably of a similar linear dimension to the distance between pin hole outlets 24. In a preferred embodiment, this is approximately 36 mm. For an effective length of plenum chamber of a preferred embodiment of 2.2 m, a compressed air supply of approximately 175 liters/sec is required which is delivered through four supply pipes 12 at a pressure of 100–120 psi (≈690–830 kPa).

With reference to FIG. 4 there is shown an exemplary mechanism for imparting a reciprocating motion to the plenum chamber 20. Plenum chamber 20 (shown in dotted outline) is mounted within structure 11 by way of the supporting bar 36 to which is rigidly attached plenum chamber inlet 21. Chamber inlet 21 passes through an elongate aperture 37 in a cover plate of structure 11. Supporting bar 36 is attached to a base plate 38 of the structure 11 by way of a rocker arm 39 and associated pivot brackets 39*a*, 39*b*, which allows substantially planar movement of the supporting bar 36, plenum chamber inlets 21 and plenum chamber 20. The elongate aperture 37 is sufficiently long to accommodate the magnitude of oscillation of the plenum chamber 20. The direction of oscillation is to the left and right as shown in FIG. 4. A flywheel 30 is driven by, for example, a pulley 32 connected to the drive shaft 31 of the tractor 5 which rotates, for example, at approximately 1000 rpm. A connecting rod 33 is pivotally mounted on flywheel 30 in an off-axis position 34 which imparts a reciprocating motion to coupling 35 to which it is pivotally mounted. Coupling 35 is attached to the supporting bar 36 on an upper surface thereof. Flywheel 30 may be driven by other means well known in the art, such as by electric motor. There may also be provided speed control means to vary the frequency of oscillation of the plenum chamber which, in a presently preferred embodiment is 300 cycles per minute (5 Hz). The frequency of oscillation could be varied as a function of the forward speed of the vehicle 5 conveying the renovating apparatus 10. In a presently preferred embodiment the forward speed of the renovating apparatus is approximately 3 m/min.

It will be understood that the benefits of having a rapidly varying horizontal position of the pin hole outlets 24 may be effected by other mechanisms which impart any suitable periodic motion to a plenum chamber: for example a circular or orbital motion is also within the scope of the present invention.

In one embodiment of the present invention, the oscillating plenum chamber 20 may be provided in conjunction with a collection chamber which provides a separation manifold such as that described in WO92/20272, and in particular as shown in FIGS. 1 and 2 of that document. With this arrangement, coarse and fine particulate matter is separated by means of the difference in momentum which has been imparted to the particulate matter by the compressed air jet system. Coarse particulate material (e.g. sand) is entrained by the air flow into the collection chamber and, by way of baffles, is entrained along a first path to be redeposited back onto the playing surface. Fine particulate material (e.g. dirt and dust) is entrained by the air flow into the collection chamber and, by way of baffles, is entrained upward along a second path through the collection chamber and into an exhaust port via which it is accumulated in a suitable containment vessel for subsequent disposal.

As has been previously described herein, such an arrangement does not always produce optimum results when the playing surface upon which renovation is being carried out is wet. In such a situation, it has been shown that it is preferable to collect and retain both the coarse and fine particulate material dislodged from the playing surface, and to subsequently deposit a fresh layer of sand or other suitable material onto the playing surface.

In accordance with a further embodiment of the present invention, there is provided means for collecting both the coarse and fine particulate material which has been dislodged from the playing surface by the action of the compressed air jets and accumulating this material for disposal or cleaning and/or further segregation.

Figure 5:
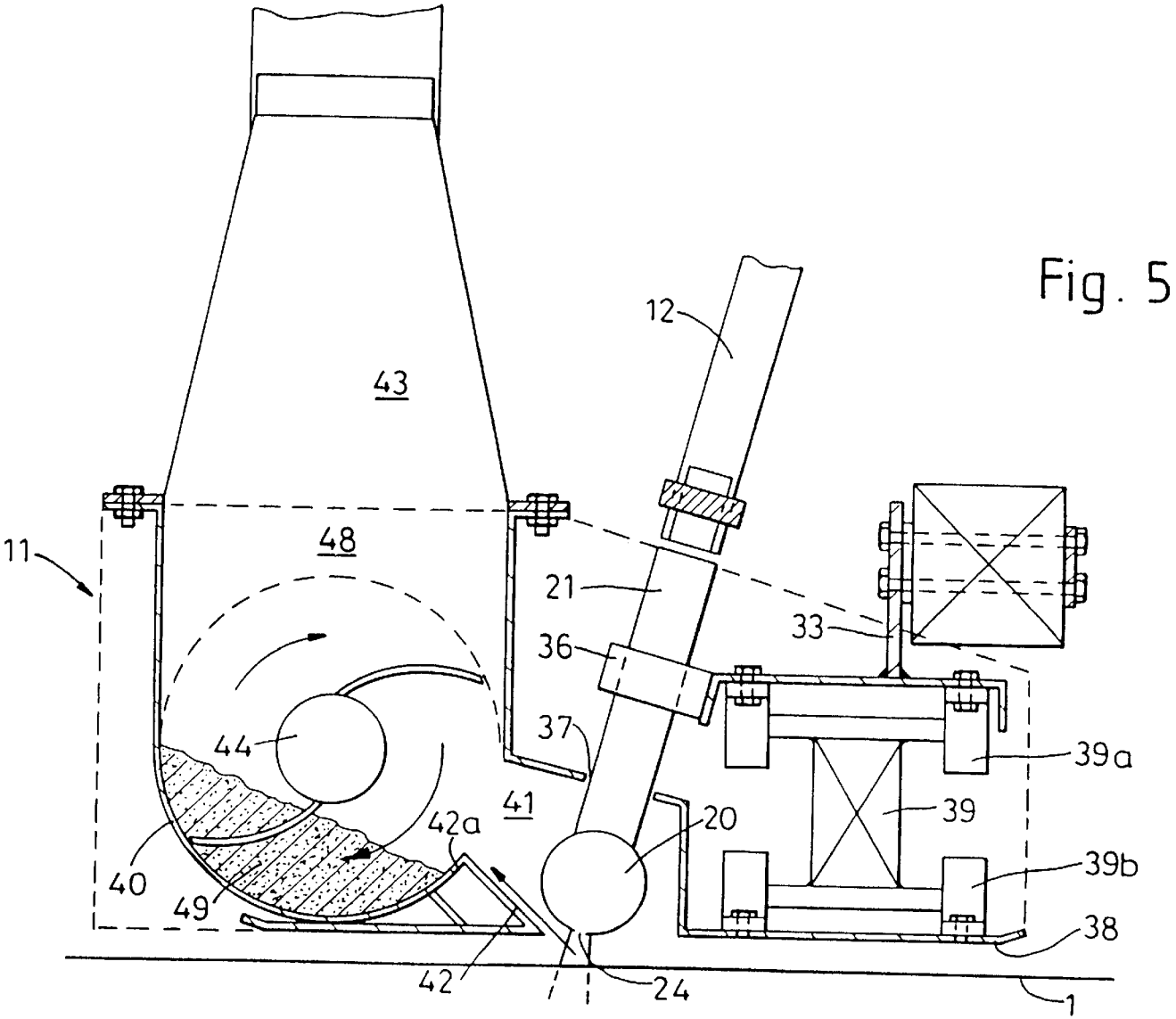
FIG. 5 shows a schematic end view of the plenum chamber and collection chamber of the renovating apparatus of FIG. 1.

The operation of a collection chamber according to one aspect of the present invention, and in conjunction with the cooperative action of the compressed air jets will now be described with reference to FIGS. 5 and 6. FIG. 5 shows a diagrammatic cross-sectional end view of the plenum chamber 20, air inlet 21 and a flexible supply pipe 12. Supporting bar 36, elongate aperture 37, base plate 38, rocker arm 39 and pivot brackets 39*a* and 39*b* are also shown. The pin hole outlets 24 in plenum chamber 20 are directed downward and slightly toward the collection chamber, preferably at an angle in the range 30° to 75° with respect to the playing surface. In the presently preferred embodiment of FIG. 5, the angle is between 60° and 75°.

Collection chamber 40 comprises an elongate semi-cylindrical structure of similar length to the plenum chamber 20 and substantially parallel thereto. The chamber 40 includes a longitudinal inlet aperture 41 located proximal to the plenum chamber 20, the aperture have a lower lip 42 projecting toward the plenum chamber 20. The lip 42 is adapted to assist in the entrainment of dislodged particulate matter into the collection chamber 40, the particulate matter having been ejected from the playing surface 1, as indicated by the arrow, by the action of the compressed air jets. The collection chamber 40 includes an upper portion 48 and a plurality of outlet apertures 43 located thereabove, in the top of the collection chamber 40. The upper portion 48 and outlet apertures 43 allow egress of air and airborne fine particulate material such as dust and dirt into an exhaust system to be described hereinafter.

Figure 6:
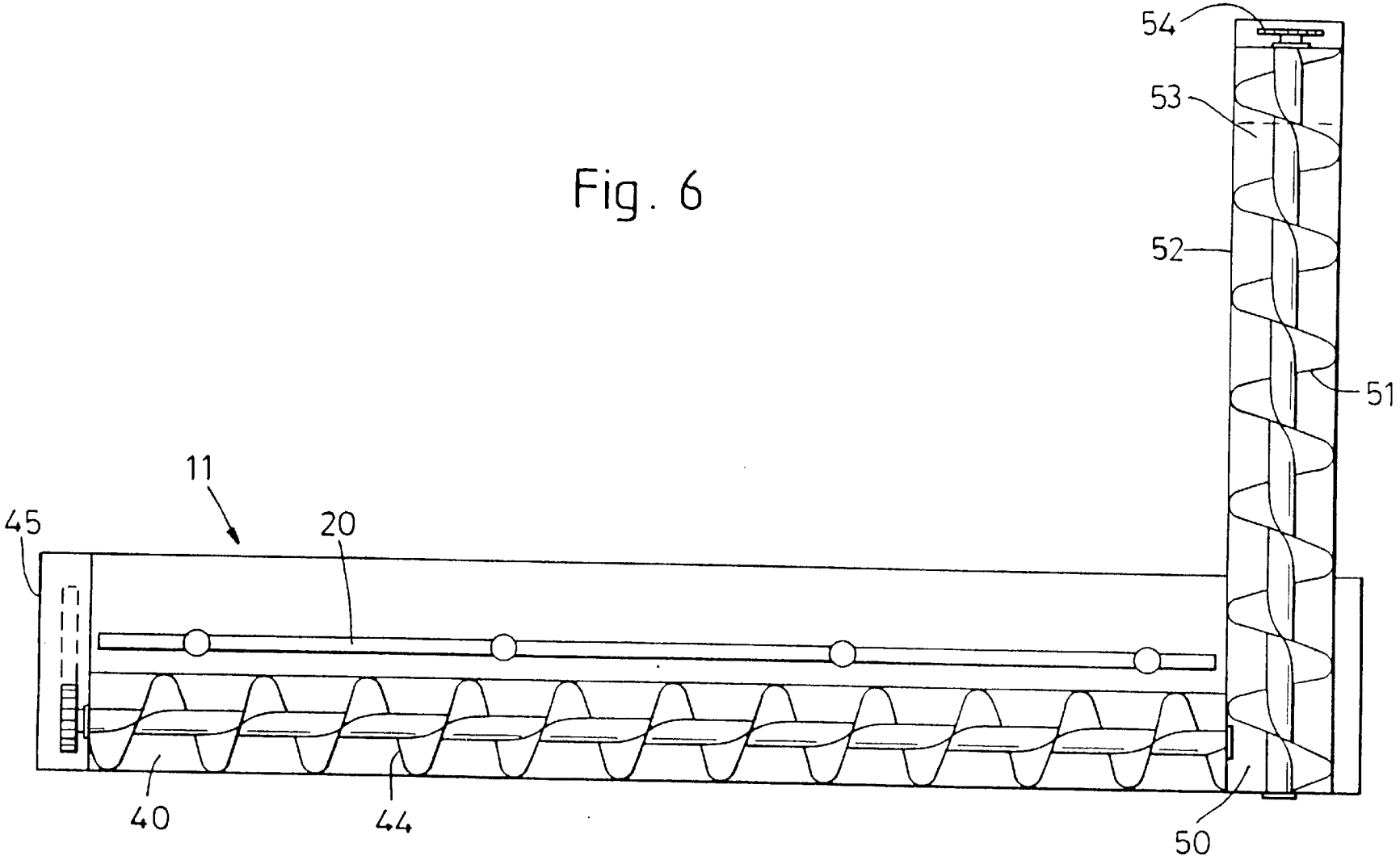
FIG. 6 shows a schematic plan view of the collection chamber and screw conveyor system of the renovating apparatus of FIG. 1.

Collection chamber 40 also includes a first screw conveyor 44 axially mounted therein, best viewed in FIG. 6. FIG. 6 shows a schematic plan view diagram of the collection chamber 40 and plenum chamber 20. First screw conveyor 44 is driven by a chain drive mechanism housed within a cover plate 45 (FIGS. 1 and 2). The chain drive (not shown) is connected to one end of a longitudinal drive shaft 46 (FIG. 2) which is driven by the drive shaft 31 of the tractor 5 through an axle box 47. In a presently preferred embodiment, the tractor drive shaft rotates at approximately 1000 rpm, and with appropriate gearing in (axle box 47 and the chain drive) causes rotation of the first screw conveyor 44 at an approximate speed of 200 rpm. It will be understood that an alternative power source may be used. First screw conveyor 44 is rotated in such a direction as to convey the coarse particulate material collected on chamber 40 in a right hand direction as viewed in FIGS. 2 and 6. With further reference to FIG. 5, lip 42 includes a raised portion 42*a* which is of sufficient height to retain sand in the lower portion of the collection volume. In practice, the rotational motion of the first screw conveyor (in a clockwise direction as viewed in FIG. 5) causes the coarse particulate material to be swept backwards and away from the lip raised portion 42*a* and to find a non-horizontal level as depicted by sand 49 in FIG. 5.

Figure 7:
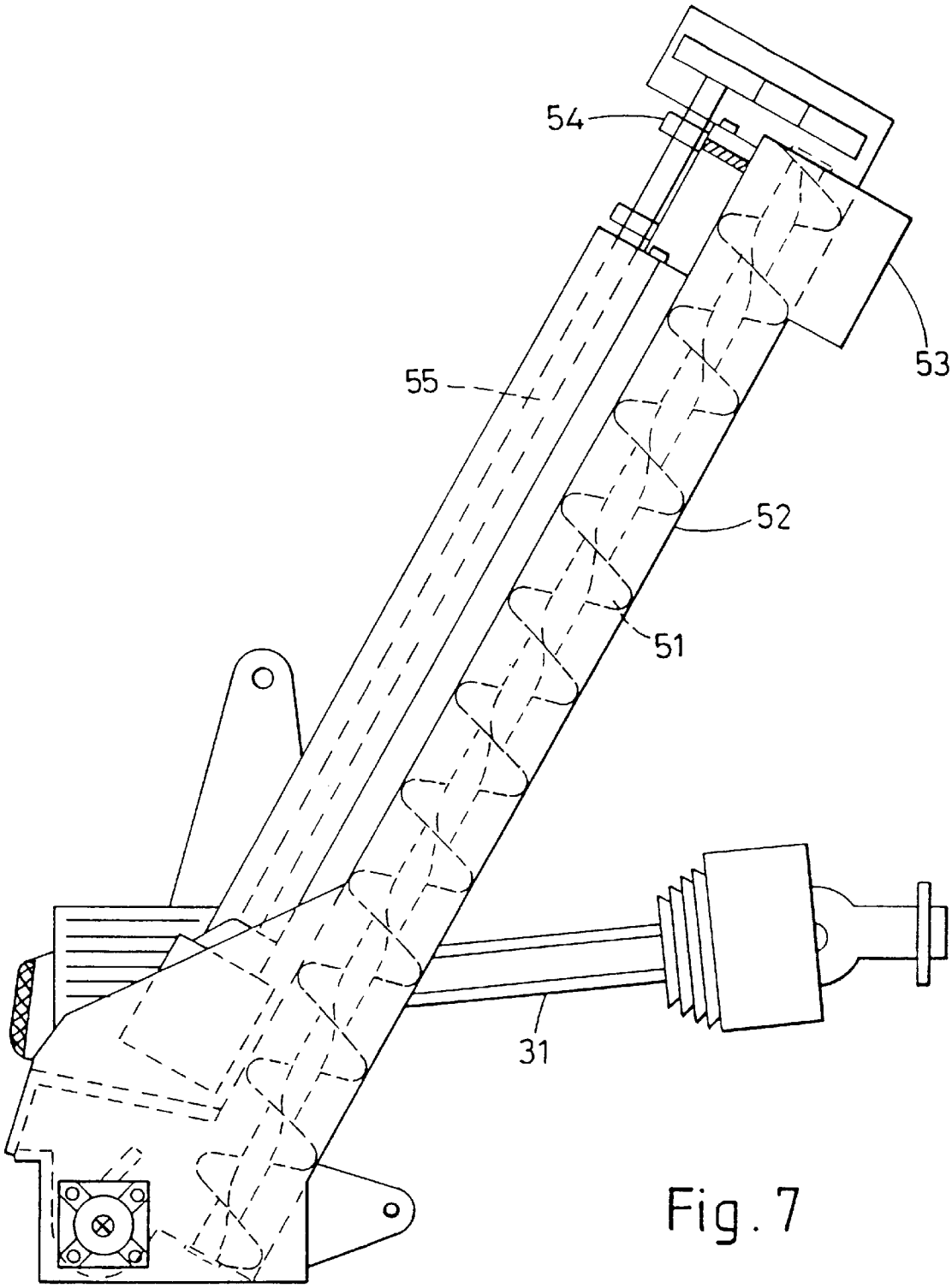
FIG. 7 shows a schematic diagram of an end view of the screw conveyor system.

At the longitudinal end of collection chamber 40 which is opposite to the chain drive cover plate 45 there is an exit chamber 50 into which the particulate material is deposited by the first screw conveyor 44. Preferably, exit chamber 50 forms the lower end of a second screw conveyor 51 which is mounted within a cylindrical casing 52 (see also FIG. 7). Second screw conveyor 51 is driven by a chain drive mechanism 54 at the upper end of a second drive shaft 55, the second drive shaft 55 being coupled at its lower end to longitudinal drive shaft 46 (see FIG. 2).

Second screw conveyor 51 is inclined upwardly and forwardly from the lower end at an approximate angle of 45° to the playing surface (see FIG. 1) which enables the coarse particulate material dislodged from the playing surface 1 to be raised to sufficient height that it can fall into an appropriate receptacle (not shown) positioned beneath an outlet 53 of cylindrical casing 52. Preferably, the receptacle is a wheeled open-top tipper truck or trailer which can be pushed along in front of the first structure 11.

The dislodged coarse particulate material may then be disposed of, and a separate sand spreading apparatus used to replenish the playing surface. Such an apparatus could be towed by or otherwise attached to the renovation apparatus.

Figure 8:
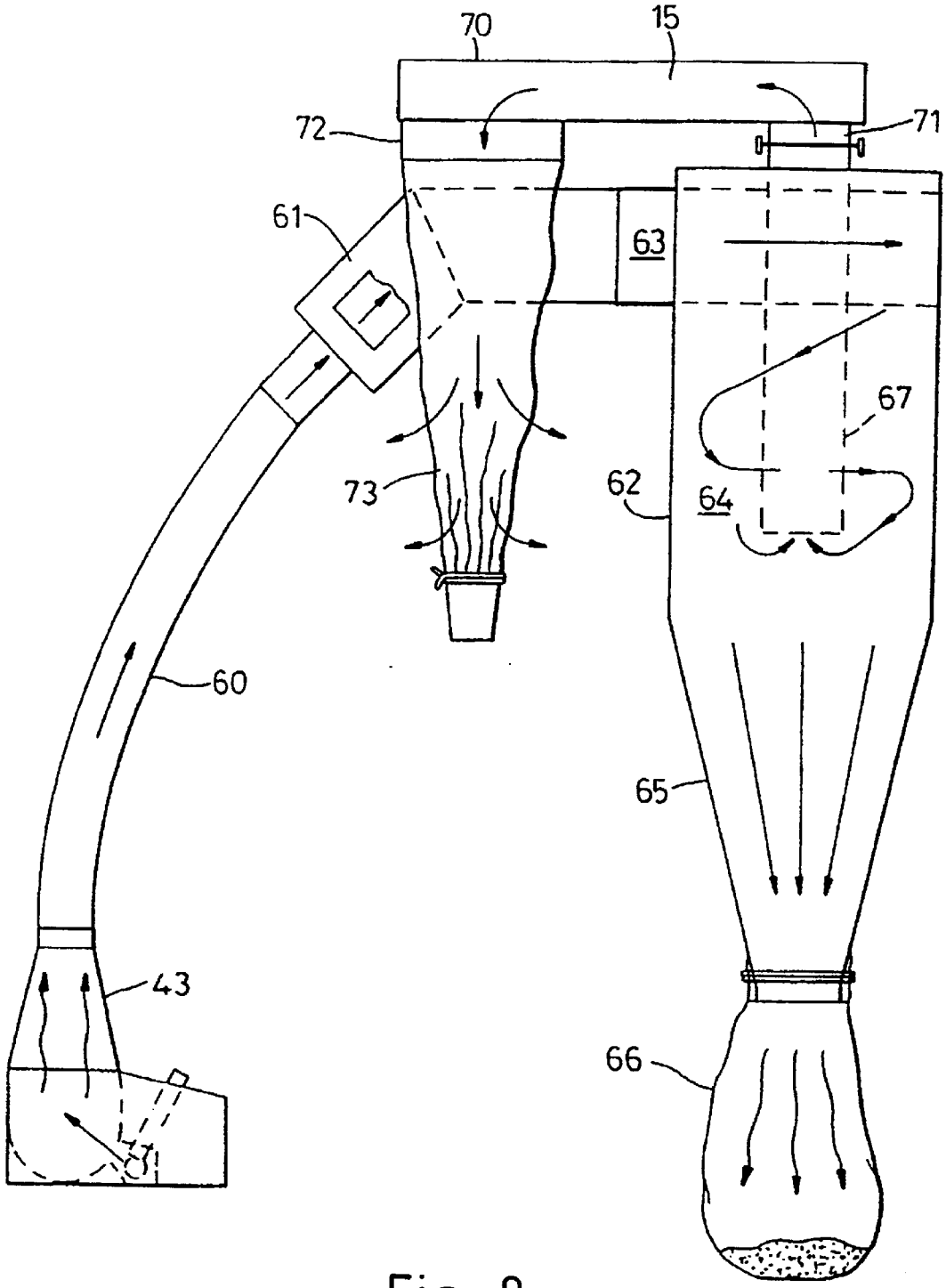
FIG. 8 shows a schematic view of dust extraction and filtering apparatus suitable for application to the renovating apparatus of FIG. 1.

With reference to FIG. 8 there is shown a schematic diagram of the exhaust system. As previously described, during the renovation process, a substantial quantity of both coarse (e.g. sand) and fine (e.g. dust and dirt) particulate material is dislodged from the playing surface 1. The coarse particulate material is sufficiently massive to fall into the collection chamber and be conveyed therefrom by the screw conveyor as described. Airborne particulate material is carried into the upper portion 48 of the collection chamber 40 where it is entrained through outlet apertures 43 by the air flow. Before venting the air to atmosphere, it is necessary to filter out all the dust and dirt to prevent its redeposition on the playing surface and also to avoid unsafe and unpleasant working conditions personnel operating the renovation apparatus.

Each outlet aperture 43 is connected to one end of a flexible exhaust pipe 60 (i.e. corresponding to one of pipes 13 in FIGS. 1 and 2), the other end of which is coupled to an exhaust manifold 61 (see also FIG. 2). Exhaust manifold 61 directs the airborne particulate material into a cyclone chamber 62 comprising an inlet port 63, expansion volume 64 to allow deceleration of the air thereby causing deposition of the airborne particulate material into the cyclone chamber. The base of the cyclone chamber includes an open ended conical section 65 for funnelling particulate material down into a collection bag 66 attached to the chamber by a suitable technique. The air is exhausted from the cyclone chamber 62 by way of a downwardly projecting outlet pipe 67 which leads to exhaust filtration unit 15.

Exhaust filtration unit 15 comprises a manifold 70 with an inlet 71 coupled to the outlet 67 of cyclone chamber 62, and a plurality of outlet vents 72 to which are coupled filter socks 73 of fine mesh fabric to retain any remaining airborne particulates.

As stated, the use of the oscillating plenum chamber increases the effective area of playing surface covered with each traversal of the vehicle 5 over that achieved by a non-oscillating plenum chamber. However, the effectiveness of the compressed air action on the playing surface is also enhanced by the oscillation, and thus need not only be used to increase the width of the apparatus. Thus the oscillating plenum chamber has utility in improving the performance of smaller machines suitable for renovating smaller area playing surfaces such as tennis courts and the like.

However, when renovating smaller area playing surfaces, the relative importance of the various features is altered. In particular, access to tennis courts and the like can be restricted by the width of the court gate unless some fencing is removed. Thus the embodiments described above may be adapted to include a smaller renovating apparatus 10 which is detachably mounted onto a small tractor 5.

In this case, the renovating apparatus may be detached and manually carried longitudinally through a narrow gate before being recoupled to the tractor.

With such a smaller scale apparatus, it may be preferable to eliminate at least one screw conveyor mechanism 51. In this case, the collection chamber 40 can be redesigned to entrain the dislodged particulate matter to a small outlet which allows the particulate matter to be deposited back onto the ground in a narrow trailed heap, rather than be collected in a suitable vessel. With a small playing surface to be renovated, the separate collection and removal of this matter is not a significant problem.

In order to further reduce the weight and size of the renovating apparatus, the dust separation apparatus may be omitted. Normally this could create dust hazards, but with a small playing surface to be renovated, the deliberate wetting of the entire surface prior to renovation can alleviate this problem, since separation of the fine and coarse particulate matter is no longer required.

A further improvement can be made to the propulsion of the tractor-driven embodiments described supra. A common problem is that the normal gearing ratios of a tractor suitable for conveying the renovating apparatus 10 are insufficiently low to allow the tractor to move forwards at a suitable rate to allow optimum action of the renovating apparatus. Typically this is solved by modification to, or replacement of, the tractor gearbox. However, this solution can substantially increase the cost of the apparatus, and increase the weight of the tractor.

In accordance with a further embodiment, the power take-off from the tractor drive shaft is used to drive an hydraulic pump which is then used to drive a roller forming an integral part of, or attached to, the renovating apparatus. This roller thus propels the entire apparatus and tractor unit along at the desired speed with significantly more control of the speed. For manoeuvring and for general conveyance, the tractor may be adapted to lift the roller off the ground and be propelled in conventional manner.

The renovation process herein described is normally accompanied by the "brushing in" of redeposited, cleaned sand, or of fresh sand, and this is commonly accomplished with reciprocating brush arrangements. It will be noted that where the renovating apparatus has been made readily detachable from the tractor unit, the same mechanism which is used to propel the plenum chamber in its oscillating path can be adapted to accept and to propel the reciprocating brush mechanism.

We claim:

1. An apparatus for dislodging particulate matter layered on a synthetic playing surface, said apparatus comprising:

a plenum chamber having a plurality of air outlets arranged in a plane through which air can be expelled at an inclined angle against said playing surface to dislodge said particulate matter; and a plenum chamber drive mechanism which imparts motion to the plenum chamber and said air outlets substantially in the plane of said air outlets.

2. An apparatus according to claim 1, wherein the motion of the plenum chamber is periodic.

3. An apparatus according to claim 1, wherein the air outlets comprise individual interchangeable jets attached to the plenum chamber.

4. An apparatus according to claim 1, wherein the air outlets are configured substantially in a straight line, and wherein the motion of the plenum chamber is a reciprocating motion substantially parallel to the line of the air outlets.

5. An apparatus according to claim 4 further including a conveyance mechanism for propelling the apparatus across said playing surface, wherein the reciprocating motion of said plenum chamber is substantially orthogonal to the direction of travel of said conveyance means.

6. An apparatus for dislodging coarse and fine particulate matter layered on a synthetic playing surface, said apparatus comprising:

a plenum chamber having a compressed air inlet and a plurality of compressed air outlets through which air can be expelled at an inclined angle against said playing surface so as to dislodge said particulate matter; and a collection chamber for collecting at least a portion of said particulate matter, said collection chamber including a first screw conveyor for removing coarse particulate matter from within said collection chamber.

7. An apparatus according to claim 6, wherein said air outlets are configured substantially in a straight line, and wherein said collection chamber has an inlet aperture for the passage of said particulate matter therethrough, and wherein said collection chamber and said first screw conveyor are mounted substantially parallel to the air outlets.

8. An apparatus according to claim 7 further including an exit chamber coupled to the collection chamber to receive coarse particulate matter displaced from the collection chamber by the first screw conveyor, and a second screw conveyor coupled to the exit chamber to displace coarse particulate matter to a position elevated from the collection chamber.

9. An apparatus according to claim 7 wherein said collection chamber includes a raised lip portion situated between said inlet aperture and said compressed air outlets adapted to entrain particulate matter into said aperture and to retain coarse particulate matter in said collection chamber once said matter has entered the collection chamber.

10. An apparatus according to claim 7 further including a conveyance mechanism for propelling the apparatus across said playing surface, wherein the collection chamber includes an exit port for depositing dislodged matter in a narrow trail behind the conveyance mechanism.

11. An apparatus according to claim 6, said apparatus further including receptacle means for receiving coarse particulate material from the elevated end of said second screw conveyor.

12. An apparatus according to claim 6, said apparatus further including an exhaust system coupled to said collection chamber for recovering air and fine particulate matter therefrom, said exhaust system including dust accumulation means for precipitating out dust from exhaust air passing therethrough.

13. An apparatus according to claim 6 wherein the air outlets comprise individual interchangeable jets attached to the plenum chamber.

14. A method of dislodging particulate matter disposed in a synthetic playing surface comprising:

providing an apparatus comprising a plenum chamber having a plurality of air outlets arranged in a plane through which air can be directed at an angle against said playing surface and a plenum chamber drive mechanism for imparting motion to said plenum chamber and said air outlets substantially in the plane of said outlets;

directing air through said air outlets toward said artificial turf to dislodge said particulate matter; and operating said drive mechanism to impart said motion to said plenum chamber.

15. A method according to claim 14, wherein said motion is a periodic motion.

16. A method according to claim 14, wherein said motion is a reciprocating motion.

17. A method according to claim 14, wherein said air outlets comprise individual interchangeable jets attached to said plenum chamber.

18. A method according to claim 14, wherein said air outlets are configured substantially in a straight line, and wherein the motion of the plenum chamber is a reciprocating motion substantially parallel to said straight line.

19. A method according to claim 18, wherein said apparatus further includes a conveyance mechanism for propelling the apparatus across said playing surface, and wherein the reciprocating motion of said plenum chamber is substantially orthogonal to the direction of travel of said conveyance means, and wherein said method further includes the step of operating said conveyance means to propel said apparatus across said playing surface.

* * * * *